United States Patent [19]

Herrmann, Jr.

[11] 4,416,738

[45] Nov. 22, 1983

[54] CHROMIUM PLATING

[75] Inventor: Richard Herrmann, Jr., Seattle, Wash.

[73] Assignee: The Boeing Company, Seattle, Wash.

[21] Appl. No.: 351,013

[22] Filed: Feb. 22, 1982

Related U.S. Application Data

[63] Continuation of Ser. No. 115,882, Jan. 28, 1980, abandoned.

[51] Int. Cl.[3] ..... C25D 5/14; C25D 5/40

[52] U.S. Cl. ..... 204/32 R; 204/35 R; 204/41

[58] Field of Search ..... 204/29, 32 R, 34, 35 R, 204/41, 51

[56] References Cited

U.S. PATENT DOCUMENTS

| | | | |
|---|---|---|---|
| 1,774,901 | 9/1930 | Piersol | 204/32 R |
| 1,942,356 | 1/1934 | Fink et al. | 204/1 |
| 2,078,868 | 4/1937 | Oplinger | 204/17 |
| 2,678,908 | 5/1954 | Tucker | 204/36 |
| 2,856,334 | 10/1958 | Topelian | 204/29 |
| 2,915,444 | 12/1959 | Meyer | 204/145 |
| 3,388,049 | 6/1968 | de Castelet | 204/29 |
| 3,551,302 | 12/1970 | Wood et al. | 204/32 |
| 3,770,286 | 11/1973 | Angilella et al. | 277/235 A |

OTHER PUBLICATIONS

F. A. Lowenheim, *Electroplating*, McGraw-Hill Book Co., New York, pp. 78–79 (1978).

Metal Finishing Guidebook and Directory 1967, Metals and Plastics Publications, Inc., Westwood, N.J. pp. 188, 190.

*Primary Examiner*—Winston A. Douglas
*Assistant Examiner*—William Leader
*Attorney, Agent, or Firm*—Christensen, O'Connor, Johnson & Kindness

[57] ABSTRACT

A method of electroplating chromium onto a metal article includes an electrolytic surface treatment step and a plating step. In the electrolytic surface treatment step the article is immersed in an alkaline solution of a cyanide salt and an electrical potential is applied to the article and reversed in polarity at predetermined intervals. The potential is preferably applied in alternating 15 second and 5 second intervals, the polarity of the potential applied to the article being positive during the 15 second intervals and negative during the 5 second intervals. A potential of between about 4 to 6 volts is preferred. The potential is applied to the article for a period of 3 to 15 minutes, preferably beginning and ending with a 15 second interval during which the polarity of the potential is positive. The article is then immersed while still wet in a chromic acid electroplating bath. After several minutes a negative plating potential is gradually applied to the article until a desired current density is obtained. Chromium is continuously plated onto the article until a sufficient thickness of chromium is obtained. The method is particularly useful for plating chromium onto a previously chromium-plated article to form a durable chromium plating.

12 Claims, No Drawings

CHROMIUM PLATING

This is a continuation of the prior application Ser. No. 115,882, filed Jan. 28, 1980, now abandoned, the benefit of the filing dates of which are hereby claimed under 35 USC 120.

BACKGROUND OF THE INVENTION

The present invention relates generally to chromium electroplating and more particularly to an improved method of electrolytically depositing chromium on a previously chromium-plated surface.

Chromium-plated articles are widely used throughout industry where a hard, chemically resistant metal surface is required. Such articles are prepared using conventional chromium electroplating techniques well known in the art. There are various instances where it is desirable or even necessary to electroplate additional chromium onto a previously chromium-plated article. However, it is well recognized in the industry that it is very difficult to successfully plate chromium onto an article having a previously deposited chromium surface. This problem, generally known as the "chrome restart problem," is known to arise even when an attempt is made to deposit an additional layer of chromium upon a relatively fresh chromium-plated surface only a few hours old. Specifically, the layer of new or additional chromium does not adhere well to the underlying chromium layer, with the result that delamination or blistering often occurs along the interface between the new and the old chromium layers.

It is also known that it is often difficult to successfully initiate chromium electrodeposition on certain other meatl surfaces, particularly iron and stainless steel. A method known as "nickel striking" is sometimes used to initiate deposition of chromium onto these metals. According to this method, a thin layer of nickel is electroplated onto, for example, a stainless steel surface from a nickel "strike," or plating solution. Nickel electrodeposition onto stainless steel is more readily accomplished than is chromium electrodeposition, and the resulting thin layer of nickel is relatively receptive to subsequent chromium electroplating. The nickel layer thus forms a base on the stainless steel that helps to ensure successful subsequent chromium plating. This method, although moderately successful, is necessarily somewhat time-consuming and requires maintenance of separate nickel and chromium plating baths.

The difficulty of depositing an additional layer of chromium onto a preexisting chromium-plated surface also makes it difficult to form a chromium layer of appreciable thickness on an article. As in the electrolytic deposition of many metals, chromium is not deposited in a perfectly smooth layer, but rather tends to form nodules and "trees" (small crystalline outgrowths) of chromium on the article as the electroplating process is carried on over a long period of time. Accordingly, to form a chromium-plated article having an appreciable thickness of chromium it has been necessary to deposit a single chromium layer in considerable excess and thereafter mill or grind the article to obtain a smooth, uniform layer of chromium of desired thickness. This method is time-consuming and relatively inefficient, particularly since the plating process typically takes a day or more and cannot be interrupted to measure the thickness of accumulated chromium without risk of being unable to restart the plating process. Consequently, the process is customarily carried out continuously for a long period of time to ensure that a sufficient thickness of chromium is deposited to allow milling to the desired thickness at all points. Nevertheless, there is an occasional failure of the electrodeposition to initiate properly. Since the article cannot be inspected during the plating process, such a failure goes undetected for a day or more until the entire process is completed. At that time the only recourse in the event of failure is to strip the chromium and repeat the process.

The chrome restart problem is also particularly acute where chromium-plated metal articles must be maintained within very precise dimensional tolerances in applications where the chromium plating is subject to wear and abrasion, as in the case for example of chromium-plated steel bearings. It is desirable in such applications to be able to deposit later an additional hard chromium layer as the initial chromium surface becomes worn. Until now it has been difficult or impossible to maintain a sufficiently thick chromium layer because of the difficulty of successfully restarting the chromium plating process. Instead of even attempting to plate additional chromium, the usual approach has been to completely strip the remaining original chromium and replate the article. Such stripping is time-consuming and is also undesirable because the use of corrosive chemical stripping agents involves a risk of damaging the underlying metal article. Also, the subsequent replating is subject to the problems mentioned above.

Accordingly, it is the general object of the present invention to provide a method of electroplating chromium that is mre reliable and efficient than has heretofore been available.

It is also an object of the present invention to provide a method of electroplating chromium onto the surface of a previously chromium-plated article.

It is another object of the present invention to provide a method for treating metal articles in preparation for chromium electroplating thereon.

It is yet another object of the present invention to provide an efficient and reliable method of electroplating a relatively thick layer of chromium onto a metal article.

It is a more specific object of the present invention to provide a method of treating a previously chromium-plated surface in preparation for subsequent electroplating of an additional chromium layer onto said surface.

SUMMARY OF THE INVENTION

The method of the present invention is generally applicable to articles that have been previously plated with chromium, as well as to any metal article of a type normally susceptible to conventional chromium electroplating. Examples of metals for which the method has been demonstrated to be operable include nickel, stainless steel, iron, copper and titanium. The method is not applicable to metals that are easily corroded in a chromic acid plating bath, for example aluminum.

In accordance with the present invention, a metal article is prepared for chromium electroplating by immersing it in an aqueous alkaline cyanide solution and applying to the article an electrical potential that is reversed in polarity at predetermined intervals. The article is then immersed in a chromic acid chromium plating bath and a cathodic plating potential is applied to the article to effect chromium electrodeposition from the plating bath.

DETAILED DESCRIPTION OF THE PREFERRED EMBODIMENT

In the preferred embodiment of the method, a metal article to be electroplated with chromium is initially cleaned and rinsed to remove organic and inorganic contaminants. Preferably, the initial cleaning of the article includes a first step of washing in a petroleum naphtha solvent, followed by a second step of washing in a hot (140° F.) alkaline bath for approximately 10 minutes with light agitation. Other conventional metal cleaning processes may also be employed. The article is then thoroughly rinsed with clean tap water.

The article is then electrolytically treated in accordance with the present invention in an aqueous alkaline cyanide pretreatment solution. The alkaline cyanide solution is preferably composed of sodium cyanide at a concentration of between approximately 14 and 40 ounces per gallon of solution and sodium hydroxide at a concentration of between approximately 5 and 20 ounces per gallon of solution. The alkaline cyanide solution may comprise between about 16.8 and 33.6 ounces of sodium cyanide per gallon of solution and between about 7.2 and 14.4 ounces of sodium hydroxide per gallon of solution. Preferably, about 29 ounces per gallon of solution of sodium cyanide are used in admixture with about 7 ounces of sodium hydroxide per gallon of solution. The alkaline cyanide solution is preferably employed to treat the article at room temperature.

An electrical potential is applied to the article while in the alkaline cyanide solution and reversed in polarity at predetermined intervals. A potential of between about 4 to 6 volts is preferred. Preferably, the potential is reversed at the ends of alternating 15 second and 5 second intervals. During the 15 second intervals the polarity of the potential applied to the article is positive; that is, an anodic or stripping potential is applied. During the 5 second intervals the polarity of the potential applied to the article is negative, or cathodic. Preferably, the application of the electrical potential to the article is both commenced and terminated with a 15 second interval during which the polarity of the potential applied to the article is positive. The reversing potential is applied in this manner for a period of about 3 to 15 minutes. It is found that such a reversing potential applied while the article is in the alkaline cyanide solution operates to treat the surface of the article in a manner that renders it readily susceptible to subsequent chromium electroplating.

When treating previously chromium-plated articles with the cyanide solution in accordance with the invention the reversing potential must normally be applied for a somewhat longer period of time than is necessary for a fresh article not previously plated with chromium.

For example, the reversing potential is applied for a period of approximately 5 to 15 minutes to a previously chromium-plated article, and approximately 3 to 5 minutes in the case of a fresh, nonchromium-plated metal article.

Regardless of the type of material being treated, it is preferred that the electrolytic treatment period is ended with a positive (anodic) polarity over an interval of about 15 seconds. The article may then be hand scoured with a fine silicone carbide abrasive paper wetted with the alkaline cyanide solution to remove minor surface irregularities. The electrolytic treatment process described above is preferably repeated at least once, although in many applications a second treatment is found to be unnecessary. Upon completion of the electrolytic treatment process the article is rinsed for 5 to 7 minutes with clean tap water. The article should not be allowed to dry following rinsing.

The article is then connected to a negative (cathodic) terminal of a power supply associated with a chromic acid electroplating bath and immersed in the plating bath while still wet with rinse water. After the article is immersed in the plating bath, no potential is applied for approximately 5 minutes. At the end of the 5 minute period, an incrementally increasing cathodic potential is applied, preferably during a period of about 1 to 2 minutes, until a current density of between approximately 1 and 3 amperes per square inch is obtained. Preferably, the current is raised in increments of 10 amperes every 10 seconds until the current density is approximately 2 amperes per square inch. The actual current will, of course, depend on the surface area of the article.

A typical plating bath comprises an aqueous solution of approximately 30 to 33 ounces of chromic acid ($CrO_3$) per gallon of solution and approximately 0.33 to 0.38 ounces of concentrated sulfuric acid ($H_2SO_4$) per gallon of solution. Such a bath is conventionally maintained at a temperature of approximately 115° F.

With the article immersed in the plating bath and the current density at the desired level, the article is left undisturbed until a suitable thickness of chromium has been deposited on the surface of the article. The article is then removed and rinsed. The chromium plating on the article may be milled and polished as necessary to achieve the desired shape, thickness and surface texture.

To achieve a particularly thick deposit of chromium, the process may be interrupted periodically and the article sanded, milled or ground to prevent buildup of nodules or trees. Prevention of the accumulation of chromium in the form of nodules and trees is generally desirable to make the most efficient use of the plating bath and to obtain a relatively uniform and homogenous layer of chromium.

The plating process may be interrupted and restarted as many times as desired, for example, to measure the thickness of the chromium plating or the quality of the chromium plating, although the electrolytic treatment must be performed each time to ensure successful restarting of the chromium plating process.

The present method is useful for plating chromium onto the surface of a previously chromium-plated article as well as onto the surface of an article having no chromium plating. In the latter case, the present method is particularly useful where a relatively thick chromium layer is required but where it is not desired to greatly overplate the article to insure a chromium layer of sufficient thickness. Contrary to the limitations of the prior art methods discussed above, the chromium plating process may be interrupted for inspection and subsequently restarted as many times as necessary when the article is pretreated in accordance with the present invention.

EXAMPLE I

To demonstrate the operation of the present method, a test was conducted on a stainless steel pipe 9 inches long and 1 inch in outside diameter. The pipe was provided with brass robbers at each end (robbers are devides used in the electroplating art to prevent excessive buildup of an electroplated metal on the edges and corners of an article being plated). The stainless steel pipe and its associated robbers had a surface area of approximately 32.5 square inches.

The pipe was initially washed in a petroleum naphtha solvent. The pipe was then washed in a hot (140° F.) alkaline bath for 10 minutes with light agitation. The pipe was then rinsed for 7 to 10 minutes with clean tap water.

The pipe was then immediately transferred to a pretreatment solution having dissolved therein 28.8 ounces of sodium cyanide per gallon of solution and 7.2 ounces of sodium hydroxide per gallon of solution. An electrical lead from a conventional power supply was connected to the steel pipe. A positive stripping (anodic) potential of 5.0 volts was then applied to the article for 15 seconds, followed by a negative (cathodic) potential of 5.0 volts for 5 seconds. The positive and negative potentials were applied to the pipe in the same manner in alternating 15 and 5 second intervals, respectively, for a total period of time of approximately 15 minutes. The 15 minute period of time was terminated with a 15 second anodic interval. Throughout this period of time, the 5 volt reversing potential resulted in an electrical current of approximately 40 amperes through the article.

The steel pipe was then rinsed thoroughly with water and transferred to a chromium plating tank containing a plating solution made up with approximately 0.33 to 0.38 ounces of concentrated sulphuric acid ($H_2SO_4$) per gallon of solution and 30 to 33 ounces of chromic acid ($CrO_3$) per gallon of solution. The plating solution was maintained at a temperature of approximately 115° F. The pipe was suspended in the bath in a vertical position by an electrical cathode lead. Four lead (Pb) anodes, having a collective surface area of approximately 4 times the surface area of the pipe and its robbers, were placed around the pipe at distances of approximately 5 inches from the pipe. The pipe was immersed for approximately 3 minutes in the chromium plating bath with no potential being applied. A cathodic, or negative plating, potential was then applied to the pipe such that the current was increased in increments of 10 amperes at intervals of 10 seconds until a plating current of 65 amperes (corresponding to a current density of 2 amperes per square inch) was attained. The pipe was plated continuously for 20 hours at constant current of 65 amperes. At the end of this period, the pipe was removed from the plating bath, whereupon it was determined that a layer of chromium 0.010 inch thick was deposited on the stainless steel pipe.

The pipe was then dried and exposed to the air for 3 days. At the end of this period the pipe was cleaned as before in an alkaline cleaning solution, rinsed and returned to the alkaline cyanide treating solution. The reversing potential was applied as before for a total period of 10 minutes, again beginning and ending the period with a 15 second anodic interval. The pipe was then rinsed with water for 7 to 10 minutes and transferred to the chromium plating bath. The pipe was immersed for 5 to 10 minutes with no current being applied. The cathodic plating potential was then gradually applied as before, with 10 amperes being applied every 10 seconds until a current of 65 amperes was attained. The pipe was plated for 10 hours. During this time a layer of chromium approximately 0.005 inch thick was deposited onto the previously chromium-plated surface of the pipe. The pipe was then removed from the solution, dried and milled to remove 0.002 inch of chromium.

The pipe was then exposed to the atmosphere for a period of one week. At the end of the week the entire procedure was repeated, the pipe being electrolytically treated with the reversing potential in the alkaline cyanide solution for a period of 10 minutes as before and immersed in the plating bath for a period of 5 hours to result in an additional layer of chromium 0.0025 inch thick.

The pipe was then exposed to the atmosphere for a period of two weeks and the procedure again repeated as before, with the exception that the plating was conducted for 10 hours to deposit an additional layer of chromium 0.005 inch thick.

The pipe was then left out for a period of one month, after which the procedure was repeated many additional times. The procedure was eventually repeated a total of 42 times for varying plating times, resulting in a final layer of chromium 0.100 inch thick on the pipe. The pipe was then subjected to exhaustive testing, including cutting, grinding, chiseling and microscopic examination in cross section. The testing revealed to delamination, blistering or other defects typically encountered in the plating of chromium onto a previously chromium-plated surface. The first chromium layer was integrally adhered to the underlying stainless steel and all subsequent chromium layers were integrally bonded together.

It was further noted that the pipe was exposed to the atmosphere between plating periods in an industrial plating plant where the air was considered relatively corrosive and polluted. No particular precautions were taken to protect the pipe from this air. Despite corrosion, oxidation and contamination of the chromium-plated surface of the pipe that was likely to have occurred, the chromium plating process was successfully restarted during each of the 42 consecutive plating periods.

Although the present invention is described by reference to a preferred embodiment, it will be understood that various alterations, modifications and substitutions of equivalents may be made by one skilled in the art without departing from the essential spirit of the invention. Accordingly, the scope of protection for the present invention granted by Letters Patent hereon is intended to be limited only by the definition contained in the following claims and equivalents thereof.

The embodiments of the invention in which an exclusive property of privilege is claimed are defined as follows:

1. A method of restarting the electroplating of chromium onto an article having an electroplated chromium coating, said method comprising the steps of:

immersing said article in an aqueous alkaline solution of a cyanide salt;

applying an electrical potential to said article immersed in said solution and reversing the polarity of said potential at predetermined intervals for a first predetermined period of time while said article is immersed in said aqueous alkaline solution; and, thereafter immersing said article in a chromic acid chromium electroplating bath and applying a cathodic plating potential to said article to electroplate chromium onto said article.

2. The method defined in claim 1 wherein said electrical potential applied to said article while said article is immersed in said alkaline solution is between 4 to 6 volts.

3. The method defined in claim 2 wherein the polarity of said electrical potential aplied to said article is reversed at the ends of alternating 15 second and 5 second intervals, the polarity of said electrical potential applied to said article being positive during said 15 second intervals and negative during said 5 second intervals.

4. The method defined in claim 3 wherein the application of said electrical potential is terminated at the end of a 15 second interval during which the polarity of said electrical potential applied to said article is positive.

5. The method defined in claim 4 wherein the application of said electrical potential to said article is commenced with a 15 second interval during which the polarity of said electrical potential applied to said article is positive.

6. The method defined in claim 5 wherein said first predetermined period of time is about 3 to 15 minutes.

7. The method defined in claim 6 wherein said article is immersed in said chromic acid chromium electroplating bath for a second predetermined period of up to about 5 minutes before said cathodic plating potential is applied to said article.

8. The method defined in claim 7 wherein said cathodic plating potential is gradually applied to said article over a third predetermined period of time of about 1 to 2 minutes immediately following said second predetermined period of time, said cathodic plating potential being gradually applied during said third predetermined period of time until a current density of between about 1 and 3 amperes per square inch is obtained.

9. The method defined in claim 8 wherein said article is rinsed with water at the end of said first predetermined period of time and thereafter immersed in said chromic acid chromium plating bath without being allowed to dry.

10. The method defined in claims 1, 2, 3, 4, 5 or 9 wherein said aqueous alkaline solution of a cyanide salt comprises an aqueous solution of sodium cyanide and sodium hydroxide.

11. The method defined in claim 10 wherein said aqueous solution comprises between about 5 to 20 ounces of sodium hydroxide per gallon of solution and between about 14 and 40 ounces of sodium cyanide per gallon of solution.

12. The method defined in claim 11 wherein said aqueous solution comprises between about 7.2 and 14.4 ounces of sodium hydroxide per gallon of solution and between about 16.8 and 33.6 ounces of sodium cyanide per gallon of solution.

* * * * *